United States Patent [19]

Takenaka et al.

[11] Patent Number: 4,707,117

[45] Date of Patent: Nov. 17, 1987

[54] COPYING MACHINE WITH ORIGINAL-POSITION CONFIRMING DEVICE

[75] Inventors: Kiyoshi Takenaka; Masahiko Ohtsuji, both of Shiga; Hiroaki Kabuto, Fukui, all of Japan

[73] Assignee: Dainippon Screen Mfg. Co., Ltd., Kyoto, Japan

[21] Appl. No.: 914,864

[22] Filed: Oct. 2, 1986

[30] Foreign Application Priority Data

Oct. 3, 1985 [JP] Japan ..... 60-152047[U]

[51] Int. Cl.[4] ..... G03G 15/00

[52] U.S. Cl. ..... 355/3 SH; 355/14 SH; 355/67

[58] Field of Search ..... 355/3 SH, 14 SH, 67, 355/8

[56] References Cited

U.S. PATENT DOCUMENTS 4,390,267 6/1983 Minor ..... 355/67
4,473,293 9/1984 Phillips ..... 355/67

FOREIGN PATENT DOCUMENTS 0228683 12/1984 Japan ..... 355/67

*Primary Examiner*—Patrick R. Salce
*Assistant Examiner*—Judson H. Jones
*Attorney, Agent, or Firm*—Lowe, Price, LeBlanc, Becker & Shur

[57] ABSTRACT

An original-position confirming device adaptable to a relatively large sized copying machine is disclosed. The device comprises a transparent base plate which is supported on a platform of a copying machine and a pair of cylindrical lamps changable between two kinds of light intensity. During a mode for confirming the position of a desired original image, the lamps are moved to a desired position suitable for confirming the original image therethrough by manipulating manual operation switches. During a mode for copying the original, the lamps traverse the original at a predetermined rate.

An operator can easily confirm the position of the original image to be copied by referring to a measuring scale provided on the platform.

3 Claims, 4 Drawing Figures

COPYING MACHINE WITH ORIGINAL-POSITION CONFIRMING DEVICE

BACKGROUND OF THE INVENTION

The present invention relates generally to a relatively large sized copying machine, e.g. a photomechanical camera, an electrophotographic copying machine and the like, and in particular to a device for confirming the position of an original image to be copied in such large sized copying machine.

Generally it is desirable for an operator to position an original which bears an original image to be copied thereon at a desired position in order to copy a desired image of the original accurately at a desired position of copying paper, e.g. paper sheet, photosensitive material or the like. However, it is difficult to do so, because the operator cannot confirm the position of the desired image of the original, which is turned down on an original holding plate of the copying machine.

It is well known such an apparatus as shown in FIG. 4, by which the operator confirms the position of an desired original image to be copied. In FIG. 4 there provided an exposure lamp 45 for exposing an original 43 which bears an desired original image to be copied onto a photosensitive material 47, and an auxiliary lamp 46 for confirming the position of the desired image through the original 43. These lamps 45 and 46 are alternatively switched over by means of a change-over switch 48 as an original pressing plate 44 is opened or closed. That is, the lamp 45 is lighted only when the photosensitive material 47 is positioned at a predetermined position on a conveyor 52, which is detected by means of a switch 49, and during the original pressing plate 44 is closed, which is in turn detected by means of a switch 48. On the other hand, the lamp 46 is lighted only when the original pressing plate 44 is opened for positioning the original on a transparent base plate 42 which is provided on a platform 41.

In such a known copying machine, the lamp 46 is designed so as to have such a light intensity as to transmit through the original 43. From such a view point, it may be desirable to use a lamp having a high light intensity, for the lamp 46. However, practically the lamp 46 uses such a lamp as having a less light intensity than that of the lamp 45, in order to avoid the damage of the base plate 42 and the original 43 caused by heat from the lamp 46, because it takes long for confirming the position of the original 43, while the lamp 46 is lighted.

In the above-mentioned known copying machine, the lamp 46 is placed apart from the optical pass between the original 43 and the photosensitive material 47, so that the original 43 placed on the base plate 42 is illuminated therefrom. As can be seen in FIG. 4, the optical system comprises the exposure lamp 45 which is movable relative to the original 43 immediately under the base plate 42, a mirror 51 provided under the base plate 42 and a lens 50 to the optical pass of which the photosensitive material 47 is positioned. The lamp 46 is placed not to interfere with the optical system. Thereupon, when the light intensity of the lamp 46 is reduced in order to avoid the problem caused by heat from the lamp 46, the light intensity thereof is apt to be insufficent at the center portion of the original 43, hence it is difficult to confirm the position of the desired original image especially in a large sized copying machine. On the other hand, in a copying machine of the type wherein an exposure lamp 45 is movable relative to the original 43 for exposing an original image onto a photosensitive material, such an auxiliary lamp as mentioned above stands in the exposure lamp's way, and thus it is difficult to provide the auxiliary lamp therein.

SUMMARY OF THE INVENTION

Accordingly, it is a primary object of the present invention to provide a copying machine having a device for confirming the position of a desired original image without any problems as mentioned above.

Another object of the invention is to provide a device for confirming the position of the original image, particularly adaptable to a relatively large sized copying machine.

The aforementioned objects are accomplished by this invention, with an apparatus which comprises: a transparent base plate on which an original bearing a desired original image to be copied is placed, said base plate being supported on a platform which forms an upper surface of said apparatus; measuring means provided on said platform for measuring the position of the desired original image; a light source for applying an illumination to said original placed on said base plate, said light source having a first light intensity for illuminating said original for confirming the position of the desired original image and a second light intensity for exposing the desired original image onto a photosensitive material, said light source being movable relative to said original; driving means for driving said light source relative to said original in different manners according to said modes; change-over means for changing over between the first mode and the second mode, during the first mode the light source being moved to a desired position where the original is illuminated for confirming the position of the desired original image, and during the second mode the light source traversing the original for exposing the desired image onto the photosensitive material.

The apparatus preferably further comprises: a translucent pressing plate pivotably provided on the platform, said pressing plate having a second measuring means on the surface thereof, whereby the position of the desired original image is confirmed therethrough during the first mode.

The driving means as mentioned above preferably comprises: at least one motor provided in said apparatus; at least a pair of pulleys, either one of said pulleys being connected to said motor; a first movable member provided between said pulleys, said first member carrying said light source thereon and being movable along the base plate; a second movable member provided between said pulleys, said second member carrying a mirror thereon, said mirror being designed to reflect the original image to the photosensitive material; first and second pulleys mounted on a common axile provided on said second member; a first conveyor belt stretched through said pair of pulleys and the first pulley, one end of said belt being connected to said first member and the other end thereof being anchored to a predetermined position of the apparatus; a second conveyor belt stretched through said second pulley, one end of said second belt being connected to said first member and the other end thereof being anchored to a predetermined position of the apparatus, whereby the optical pass of said apparatus between the original and the photosensitive material is constant independent of the movement of said light source.

Having the aforementioned features, the present invention produces practically useful advantages as follows: an operator can easily confirm the position of a desired original image, even when a relatively large sized copying machine is used.

The copying machine can be a simple construction with a compact scale.

Other novel features and advantages of the invention will become apparent in the course of the following detailed description together with the accompanying drawings, which are directed only to the understanding of the present invention and not to the restriction of the scope of the invention.

DETAILED DESCRIPTION OF THE PREFERRED EMBODIMENT

Figure 1:
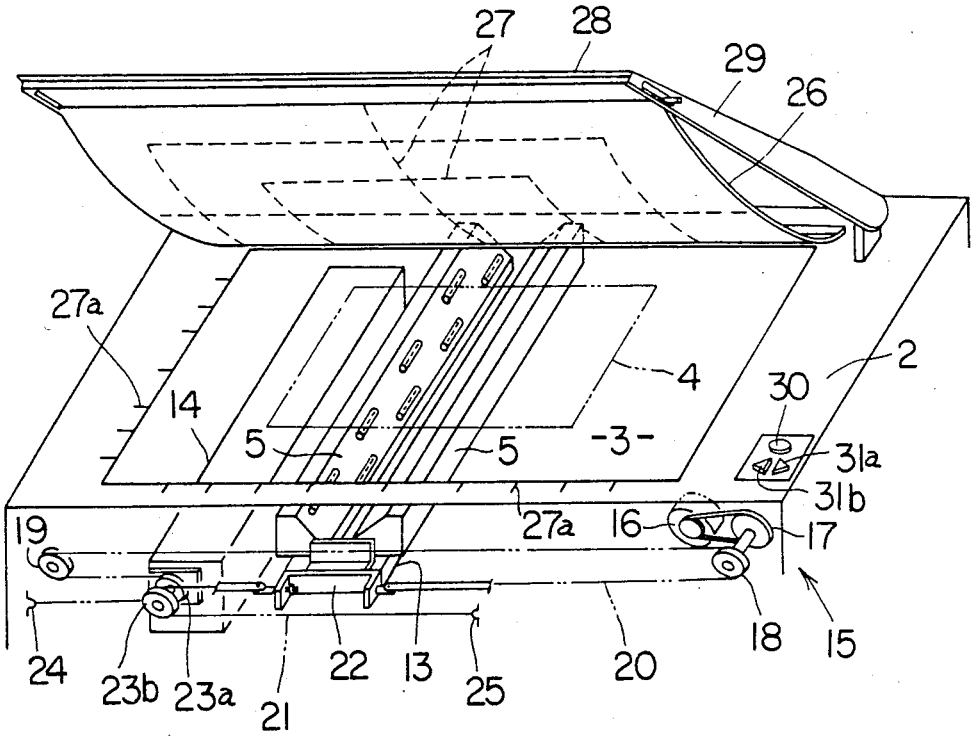
FIG. 1 is a perspective view of a part of an embodiment of the present invention.
Figure 3:
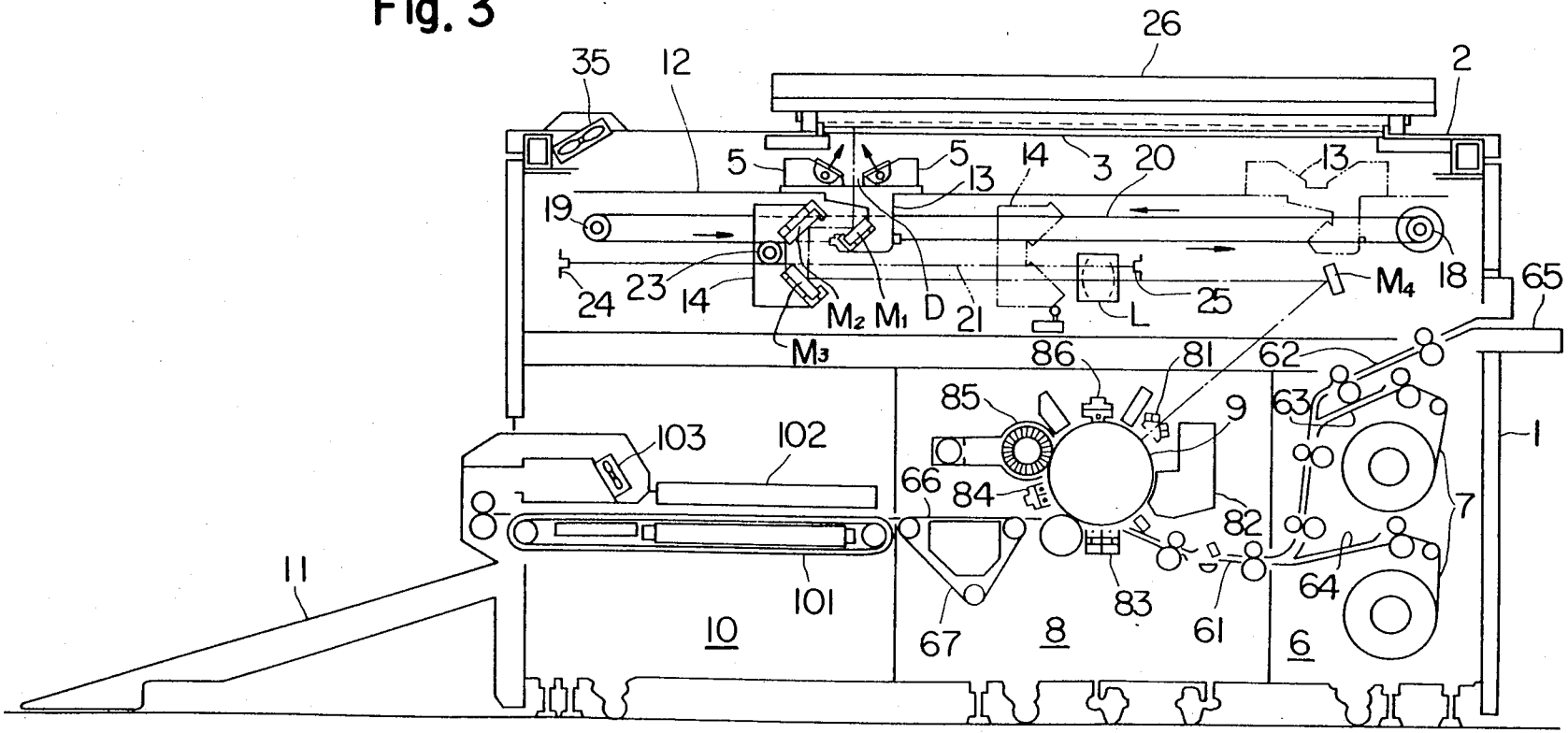
FIG. 3 is an elevational view of the embodiment shown in FIG. 1.

Referring to FIGS. 1 and 3 which show an electrophotographic copying machine according to the present invention, a platform 2 forms an upper surface on a frame 1, on which a transparent base plate 3 is supported, and an original 4 bearing a desired original image is received thereon. A measuring scale 27*a* is provided on the platform 2 along two edges of the base plate 3, by which an original to be copied is positioned thereon.

A pair of cylindrical lamps 5 are mounted on a pair of lamp holders 5', respectively, and the holders are in turn provided on a movable member 13. The lamps 5 are slightly inclined so as to illuminate the original 4 placed on the base plate 3. An opening D is defined by the lamp holders 5', through which light reflected from the original 4 is passed. The member 13 is movable along the base plate 3 immediately thereunder, and the original is scanned as the member 13 traverses the same.

Immediately under the opening between the holders 5', there provided a mirror M1 on the lower portion of the member 13 so as to transfer the light passed through the opening in the horizontal directions.

Another movable member 14 is provided movably along the base plate 3, hence in the horizontal directions, on which a pair of mirrors M2 and M3 are mounted in such a manner as the light transferred from the mirror M1 is in turn transferred in the horizontal direction to a lens L.

On the optical pass of the lens L there provided a mirror M4 in such a manner as the light impinges on a photosensitive drum 9 which rotates synchronously with the movement of the member 13, by which a latent image is formed thereon. Around the drum 9 there provided various elements, e.g. a diaphram 81, a toner developer 82 by which a toner image is produced, a toner transfer device 83, a discharger 84, a cleaning device 85 and an electrizer 86, which are arranged in recording unit 8 and do not directly relate to the essential of the present invention, and therefore the explanation on these functions is omitted.

To the lower end of the drum 9 a paper path 61 is connected, which extends from a paper supply unit 6. The path 61 is forked into three paths 62, 63 and 64, and various pairs of feed rollers are provided on these paths. The path 62 extneds to a stage 65, through which a sheet paper is supplied. Paper rolls 7 having different width are provided at respective ends of paths 63 and 64, through which paper is selectively supplied. Paper to which a toner image is transferred is selectively supplied through either one of paths to the drum 9.

From the lower end of the drum 9 another paper path 66 extends to a fixing unit 10, in which paper bearing a toner image thereon is conveyed by conveyer devices 67 and 101. The toner image is fixed by a fixing device 102 as paper is conveyed along the path. A blower 103 is provided next to the fixing device 102, by which the image is dried, and then paper is discharged to a receiving stage 11.

As mentioned above, the members 13 and 14 are moved along a pair of rails 12 as shown by arrows. The driving mechanism of the members 13 and 14 is designed as follows. That is, a motor 16 is mechanically connected to a pair of pulleys 18 and 19. Pulleys 23*a* and 23*b* are coaxially mounted on a common axile of the member 14. A conveyer belt 21 is stretched through the pulleys 18, 19 and 23*a*. One end of the belt 20 is fixedly connected to a support 22 which is in turn mounted to the member 13, and the other end of the belt 20 is anchored to a predetermined position 24 of the copying machine. Another conveyer belt 21 is stretched through the pulley 23*b*. One end of the belt 21 is fixedly connected to the support 22, and the other end thereof is anchored to a predetermined position 25 of the copying machine. These conveyor belts 20 and 21 are so designed as to drive the member 13 and 14 while the optical pass from the original 4 to the drum 9 is constant independent of the movement of the members 13 and 14. That is, the member 13 traverses the original 4 from the position illustrated by continuous line to the position illustrated by chain line, while the member 14 is moved by half length of the movement of the member 13. Thus, it will be apparent that the pulleys 23*a* and 23*b* function as a running block.

On an upper side of the copying machine another blower 35 is provided for exhausting the heat caused by the lamps 5, which prevent the undersirable effects to the copying machine.

On the platform 2 a translucent pressing plate 26 is pivotably mounted. The pressing plate 26 is supported by a pair of vertical frames 29 and a lateral frame 28, and a measuring scale 27 is provided thereon. It is desirable that the pressing plate 26 is made of a flexible resin material and is coated on the lower surface thereof, by which the pressing plate 26 has a reflectiveness suitable for copying the original and transitancy suitable for confirming the position of the original image therethrough. The measuring scale 27 is provided on the upper surface of the pressing plate.

A change-over switch 30 is provided on the other side of the platform 2, which changes over between a mode for confirming the position of the original 4 to be copied and a mode for copying the original image. A pair of switches 31*a* and 31*b* are provided adjacent to the change-over switch 30. The lamps 5, hence member 13, is moved to a desired position, by manipulating the switches 31*a* and 31*b*, where the position of the original image to be copied is confirmed by an operator, and if the original is incorrectly positioned on the base plate 3, the operator can position the original correctly.

Figure 2:
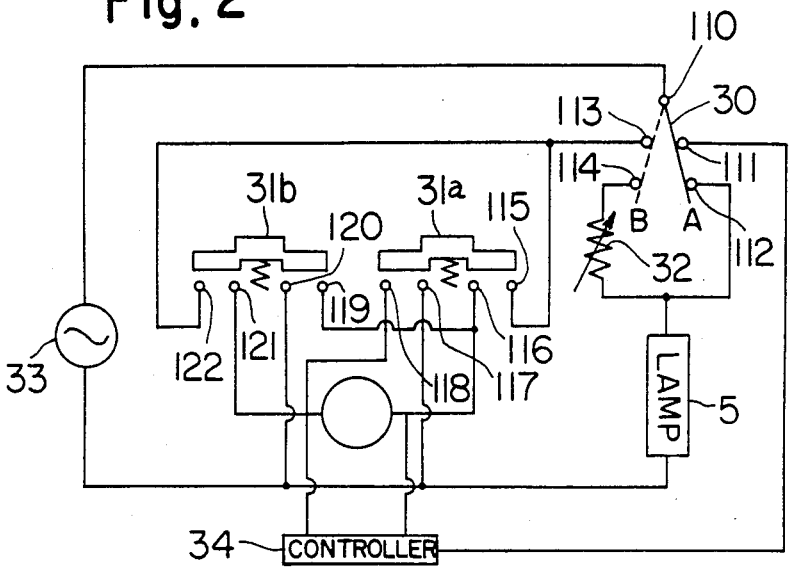
FIG. 2 is a circuit diagram of a driving circuit which is adaptable to the invention.
Figure 4:
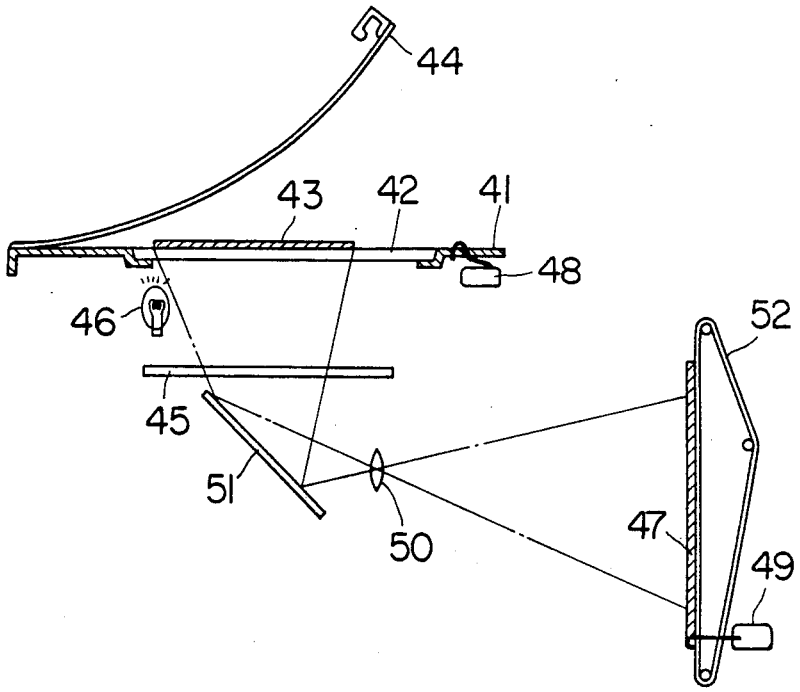
Fig. 4 Prior Art
FIG. 4 is a schematic view of showing a known copying machine.

Referring to FIG. 2 which shows a circuit diagram of the driving circuit for driving the lamps 5, hence the member 13, the change-over switch 30 is moved between the positions A and B. A terminal 111 is connected to a motor controller 34. Another terminal 112 is connected to the lamps 5, and these terminals 111 and 112 are connected each other when the switch 30 is in the position A. The lamps 5 are connected to a terminal 117 and a power source 33, respectively. The poewr source 33 is in turn connected to a terminal 110 of the switch 30. A terminal 113 is connected to a terminal 115 of the switch 31*a* and a terminal 122 of the switch 31*b*, respectively. A terminal 114 is connected to the lamps 5 through a variable resistor 32, and these terminals 113 and 114 are connected each other when the switch 30 is in the position B. A terminal 116 of the switch 31*a* is connected to a terminal 119 of the 31*b*, the motor 16 and the motor controller 34, respectively. A terminal 118 is connected to the motor controller 34, the motor 16 and a terminal 121, respectively. A terminal 120 of the switch 31*b* is connected to the power source 33 and the lamps 5, respectively. A terminal 122 is connected to the terminal 113 and the terminal 115, respectively. The motor controller 34 is designed so that the motor 16 moves the lamps 5, hence the member 13, at a desired rate according to a predetermined program during the mode for copying the original image.

When the switch 30 is moved to the position B, the light intensity of the lamps 5 is reduced by the resistor 32, which is adaptable for confirming the original image through the original. During the switch 31*a* is pushed, the lamps 5 are moved in the right direction, and on the contrary, during the switch 31*b* is pushed, the lamps 5 are moved in the left direction.

At the positioning operation of the original, an operator changes into the mode for confirming the position of the original image to be copied by operating the switch 30. Then, the lamps 5 are lighted with reduced intensity. The operator places the original to be copied on the base plate 3 so that the surface bearing a desired original image thereon is faced downwards, and he positions the original 4 approximately so as to have the desired original image copied on paper in a desired layout. As mentioned above, various kinds of paper with different width are available for the copying machine, he can, however, confirm the paper size to be used by referring to the measuring scale 27*a*. Then, he closes the pressing plate 26 on the original 4. The original image can be seen through the pressing plate 26 because of illumination of the lamps 5, which is moved to a desired position by manipulating the switches 31*a* and 31*b*. The operator can confirm the position of the desired original image to be copied accurately, and if the position is incorrect, he positions the original 4 correctly on the base plate. It is apparent, of course, that he can confirm the position of the original image correctly without closing the pressing plate.

The above description is directed to a case wherein the invention is applied to an electrophotographic copying machine. However, it should be understood that the described embodiment is only an example to facilitate the understanding of the present invention. Accordingly, the invention is not restricted to the above embodiment whatsoever. This invention is also applicable to various kinds of copying machine.

We claim:

1. An apparatus having relatively large size for copying an original comprising:

a transparent base plate on which an original bearing a desired original image to be copied is placed, said base plate being supported on a platform which forms an upper surface of said apparatus;

measuring means provided on said platform for measuring the position of the desired original image;

a light source for applying an illumination to said original placed on said base plate, said light source having a first light intensity for illuminating said original for confirming the position of the desired original image and a second light intensity for exposing the desired original image onto a photosensitive material, said light source being movable relative to said original;

driving means for driving said light source relative to said original in different manners according to said modes;

change-over means for changing over between the first mode and the second mode, during the first mode the light source being moved to a desired position where the original is illuminated for confirming the position of the desired original image, and during the second mode the light source traversing the original for exposing the desired image onto the photosensitive material.

2. An apparatus set forth in claim 1, further comprising:

a translucent pressing plate pivotably provided on the platform, said pressing plate having a second measuring means on the surface thereof, whereby the position of the desired original image is confirmed therethrough during the first mode.

3. An apparatus set forth in claim 1, wherein said driving means includes:

at least one motor provided in said apparatus;

at least a pair of pulleys, either one of said pulleys being connected to said motor;

a first movable member provided between said pulleys, said first member carrying said light source thereon and being movable along the base plate;

a second movable member provided between said pulleys, said second member carrying a mirror thereon, said mirror being designed to reflect the original image to the photosensitive material;

first and second pulleys mounted coaxially on a common axile provided on said second member;

a first conveyor belt stretched through said pair of pulleys and said first pulley, one end of said belt being connected to said first member and the other end thereof being anchored to a predetermined position of the apparatus;

a second conveyor belt stretched through said second pulley, one end of said second belt being connected to said first member and the other end thereof being anchored to a predetermined position of the apparatus, whereby the optical pass of said apparatus between the original and the photosensitive material is constant independent of the movement of said light source.

* * * * *